United States Patent [19]

Möe

[11] 4,038,937

[45] Aug. 2, 1977

[54] MEDICINE DISPENSER AND METHOD

[76] Inventor: Kjell Möe, Stockbyvagen 3A, Stocksund, Sweden

[21] Appl. No.: 680,176

[22] Filed: Apr. 26, 1976

[51] Int. Cl.[2] ..... G09F 9/00

[52] U.S. Cl. ..... 116/121; 206/538

[58] Field of Search ..... 116/121, 135; 206/538, 206/539; 217/62; 312/234.4, 234.3, 234.2, 234.1, 234

[56] References Cited

U.S. PATENT DOCUMENTS

| | | | |
|---|---|---|---|
| 1,154,702 | 9/1915 | Langseth | 217/62 |
| 2,115,021 | 4/1938 | Joffee | 312/234.4 |
| 2,132,652 | 10/1938 | Schmiedeman | 312/234.4 |
| 3,537,422 | 11/1970 | Moe | 206/539 |
| 3,618,559 | 11/1971 | Moe | 116/121 |
| 3,627,122 | 12/1971 | Garbe | 116/121 |
| 3,871,551 | 3/1975 | Bender | 116/121 |
| 3,904,075 | 9/1975 | Richardson | 116/121 |

*Primary Examiner*—S. Clement Swisher
*Assistant Examiner*—Denis E. Corr
*Attorney, Agent, or Firm*—William E. Mouzavires

[57] ABSTRACT

An improved portable dispenser for medicines, medical preparations or drugs such as in the form of pills, tablets, capsules, etc., has a disposable tray insert, including separate receptacles or compartments corresponding to four periods per day over the course of a week totaling twenty-eight receptacles. The dispenser includes a tray which is charged each week with the tray insert containing the prescribed week's dosage for the patient. The tray and its insert are made with interfitting parts so that the tray insert can only be placed in the tray with the medicine properly positioned according to the correct time at which it should be taken by the patient. The tray with its insert are received in a case having movable transparent cover strips slidable in the top of the case between positions closing the top of the tray insert compartments and open positions exposing the insert compartments to permit their contents to be dispensed. In one preferred embodiment, the tray insert is provided with a top cover sealing the medicine contents for sanitary purposes. When inserted in the case, the cover is automatically stripped from the insert to expose the medicines for dispensing after the movable cover strips are slid to open position.

24 Claims, 11 Drawing Figures

FIG. 6
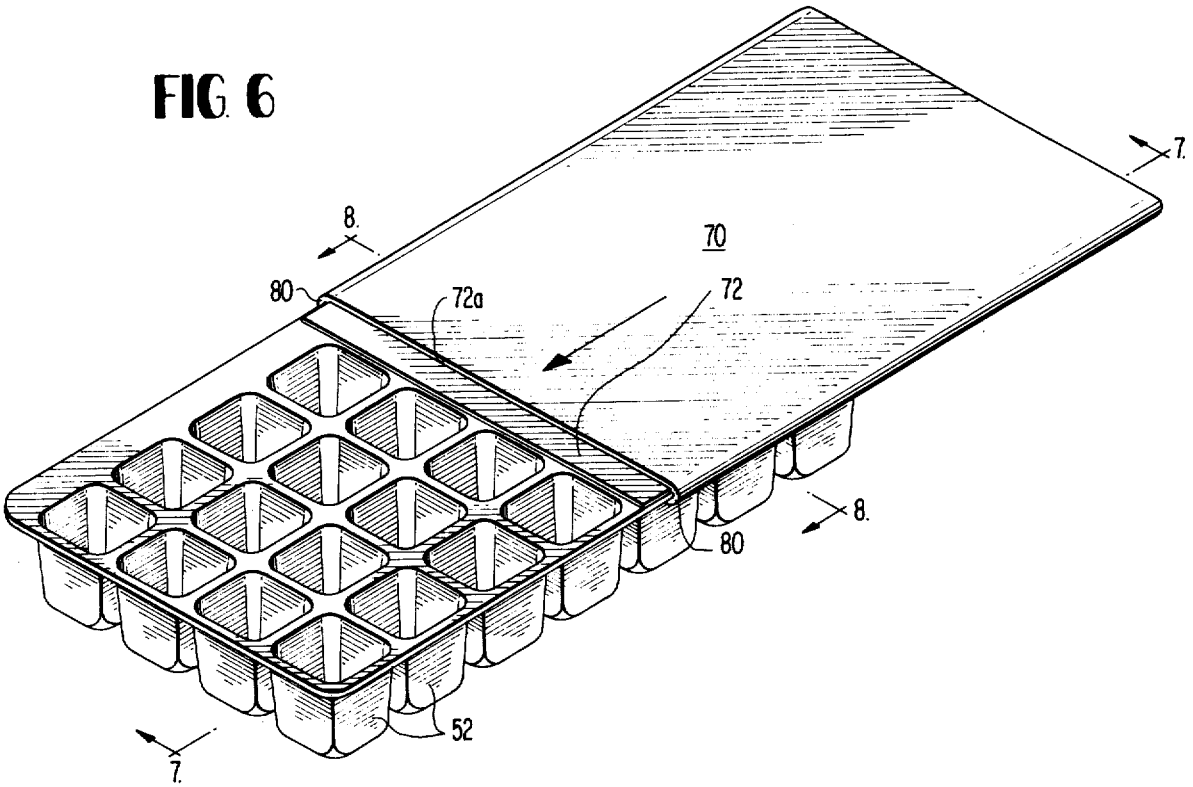
FIG. 7
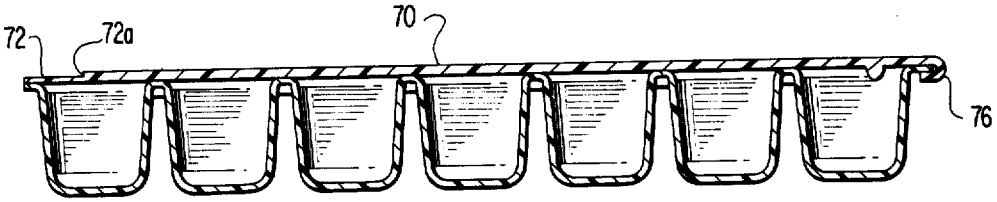
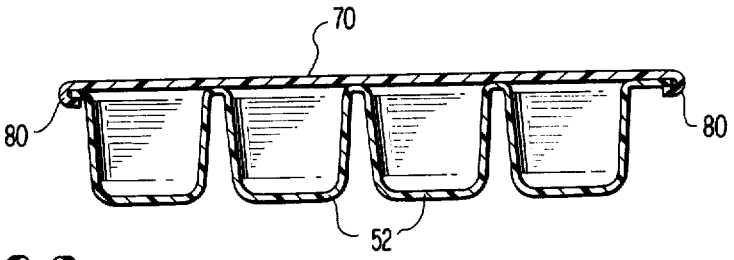
FIG. 8

MEDICINE DISPENSER AND METHOD

RELATED PATENTS

This application is directed to improvements over the medicine dispensers and methods disclosed in my U.S. Pat. No. 3,537,422, issued Nov. 3, 1970 and U.S. Pat. No. 3,618,559, issued Nov. 9, 1971; the latter being a division of the former.

BACKGROUND AND OBJECTS OF INVENTION

With the proliferation of new and different types of medicines to be taken by patients at definite different prescribed times, the need for taking the correct medicine at the correct time, in many cases, has become just as important as the medicine itself. The dispensing method disclosed in my prior U.S. patents, identified above, has fulfilled the need in providing programmed dispensing of medicines that can be used by the patient without supervision from a physician or nurse. According to this method, medicines are prearranged in a portable, easy to use, dispenser according to the time in which the medicines should be taken as prescribed by a doctor, nurse or pharmacist.

The present invention improves the method and structure by which the medicines are charged into the dispenser and stored there in a highly efficient and sanitary manner. To this end, the present invention provides improved dispenser structure and methods by which medicines can be inserted and stored in a dispenser in an organized, programmed manner which is highly sanitary as well as efficient.

Included herein is the provision of an improved medicine dispenser case and associated tray received therein which can be utilized to dispense medicine in accordance with the latter objects as well as the methods disclosed, for example, in my U.S. Pat. No. 3,618,559, identified above.

A further object of the present invention is to provide a disposable tray insert which can be filled by a doctor or pharmacist with the prescribed dosage in prearranged positions to be taken by a patient according to the precise prescribed times, and which insert can be easily placed into a dispenser case by the patient and used until exhausted of its medicine contents at which time the insert can be discarded and replaced by another insert containing the proper dosage for the next weekly period or another suitable period.

Another object of the present invention is to provide such a tray insert whose medicine contents are sealed for sanitary purposes prior to insertion into an associated dispenser case. Included herein is such a tray insert that is automatically unsealed or opened for dispensing its contents, upon placement of the tray insert into the associated dispenser case.

SUMMARY OF INVENTION

In summary, the preferred embodiment of the present invention includes a medicine or dosage tray and a disposable tray insert having medicine compartments or receptacles corresponding to the times each day when the medicine contents thereof are to be taken over the course of a period, such as a week. The tray insert may be charged by a pharmacist or doctor or the patient himself, after which it is inserted into the associated tray, after which the tray with the tray insert therein is inserted into a box-like dispenser case.

The tray and its insert are designed so that the insert can only be inserted in the tray in the proper position, that is, with the medicine arranged according to the prescribed time the medicine is to be taken. To this end, the tray is provided with a plurality of positioning elements or stops that are to be received between the insert compartments to properly position the insert in the support tray. Once the insert is positioned in the tray, the tray can only be inserted in the dispenser case in the correct position.

The dispenser case which receives the tray with its insert, has a plurality of transparent cover slats or strips which are movable from a closed position closing the tray insert compartments to an open position to expose any of the compartments to permit their contents to be taken by the patient.

In one preferred embodiment of the invention, the tray insert is provided with a sealing cover that is placed over its medicine compartments after they are filled with medicine, for example, by a pharmacist. When the tray with its insert are inserted into the case, the sealing cover is automatically stripped from the tray insert to expose the medicines in the insert compartments for dispensing when the overlying cover strips of the case are moved to open position.

DRAWINGS

Other features, objects and advantages of the present invention will become apparent from the following more detailed description taken in conjunction with the attached drawings in which:

FIG. 6 is a perspective view of a tray insert with a sealing cover (shown partially removed) in accordance with a preferred modification of the invention;

FIG. 7 is an enlarged cross-sectional view taken generally along lines 7—7 of FIG. 6 but with the sealing cover in proper position closing all of the medicine compartments of the tray insert;

FIG. 8 is an enlarged cross-sectional view taken generally along lines 8—8 of FIG. 6;

Figure 9:
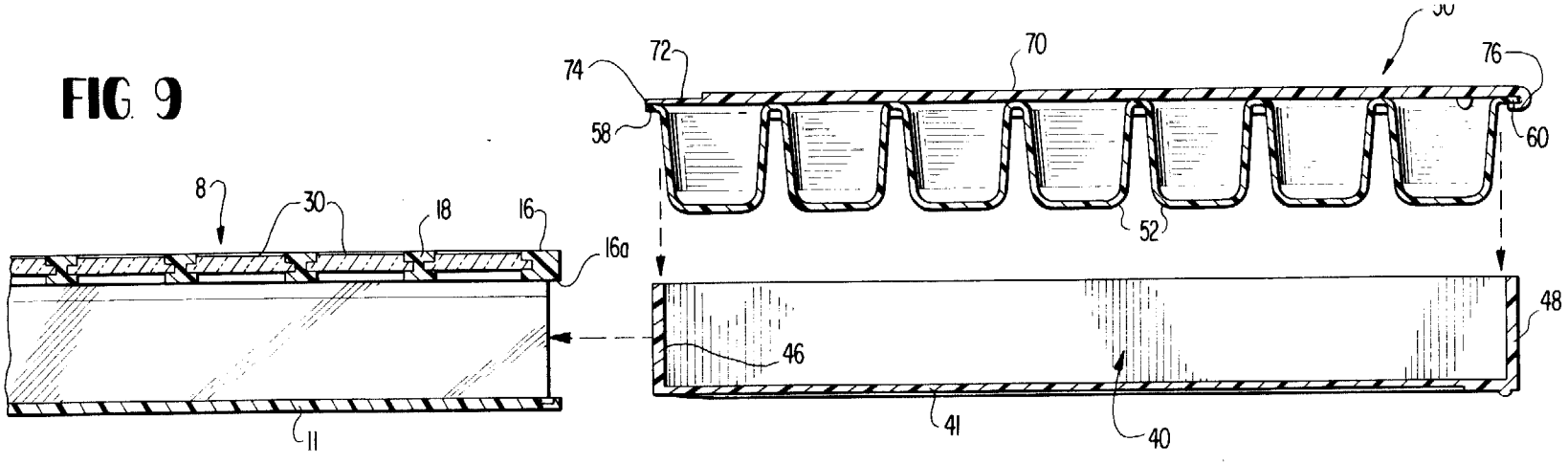
Figure 10:
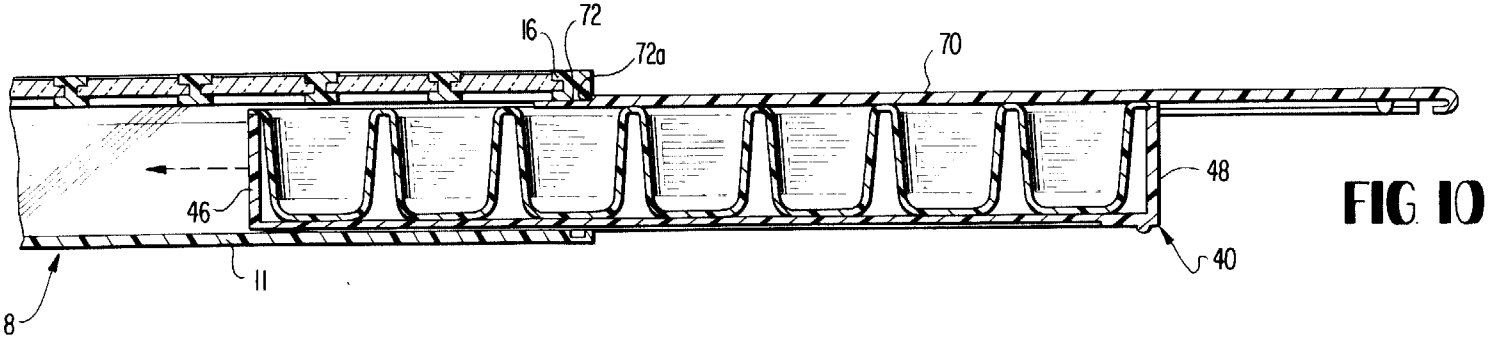
Figure 11:
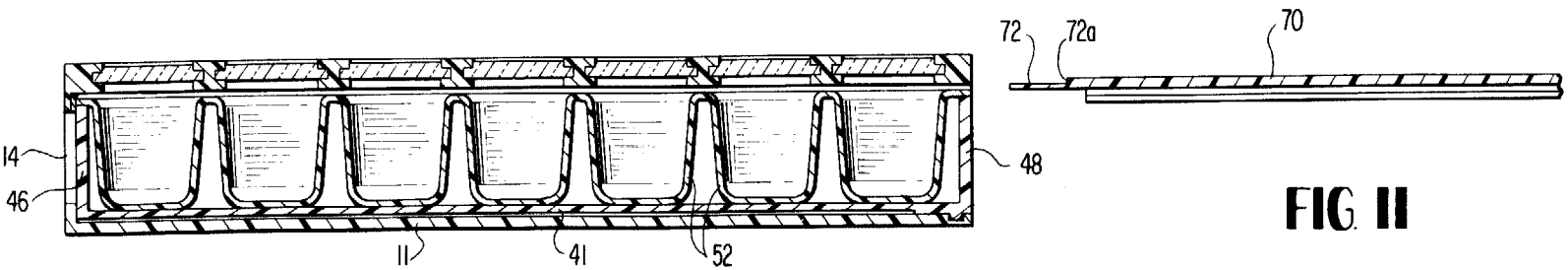

FIG. 9 is an elevational, assembly view in cross section illustrating how the preferred tray insert of FIG. 8 is installed in the tray which is positioned to be inserted in the case, the latter being shown in fragment; and FIGS. 10 and 11 are elevational views similar to FIG. 9 showing sequential stages of insertion of the tray with its insert into the case and removal of the sealing cover from the tray insert.

DETAILED DESCRIPTION

Figure 1:
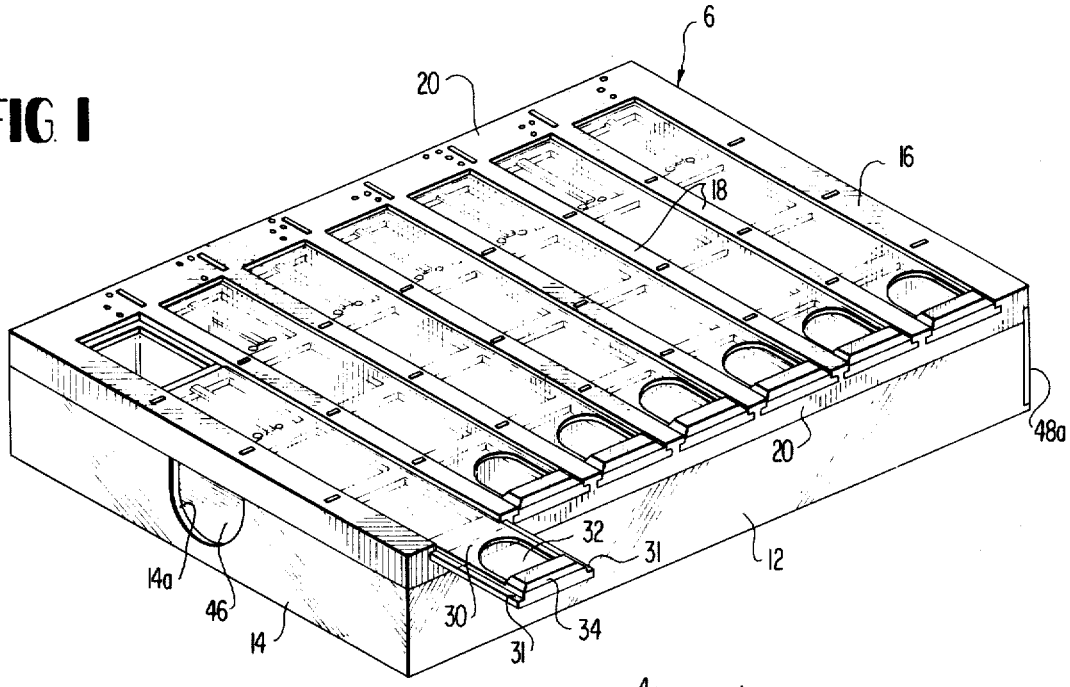
FIG. 1 is a perspective view of an improved medicine dispenser embodying the present invention and shown with one of its cover strips in an open position.
Figure 5:
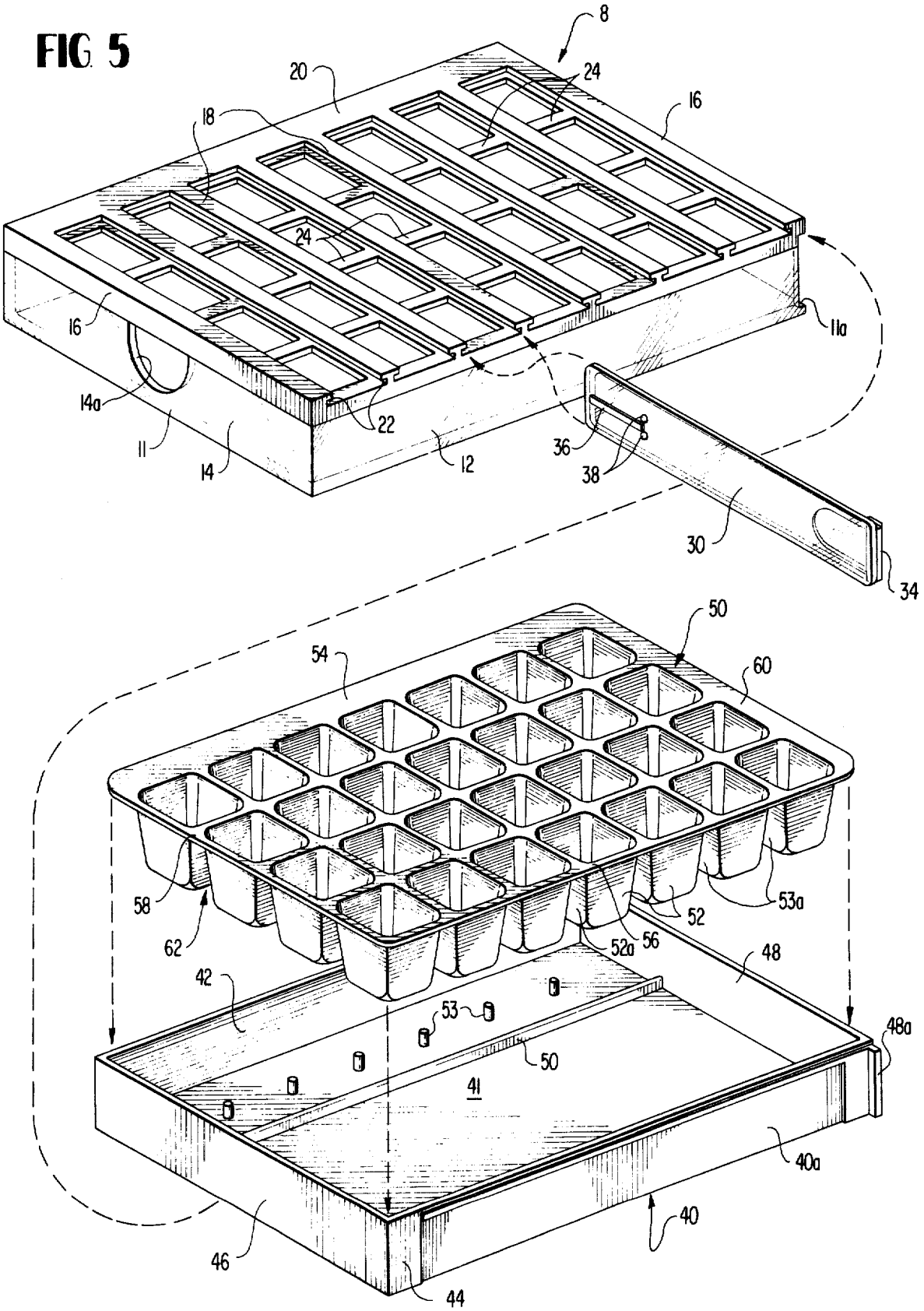
FIG. 5 is an exploded, perspective view of the dispenser parts with certain omissions, illustrating how the parts are assembled.

Referring now to the drawings in detail, and initially FIGS. 1 and 5, there is shown, for illustrative purposes only, an improved medicine dispenser generally designated 6 (FIG. 1) embodying the present invention. As shown in FIG. 5, the dispenser includes three basic parts, namely, a case generally designated 8, a tray generally designated 40 receivable in the case, and a tray insert generally designated 50 receivable in the tray.

Case 8 includes a base 11 which is rectangular in the shown embodiment, and opposite side walls 12 and 14 and one end wall 11 upstanding from the base with the opposite end of the case being open for receiving the tray 40 as will be described. On side wall 12, 14 and end wall 11, is a top including opposite end pieces 16 joined by side pieces 20. Extending between side pieces 20 in parallel to the end pieces 16, are a plurality of ribs 18 having a generally T-shaped cross section defining recesses 22 for slidably receiving and guiding transparent cover slats or strips 30 to be described further below. Extending transversely of ribs 18 throughout the top of the case are a plurality of support ribs 24 for supporting transparent cover strips 30 for sliding movement in recesses 22. Parts of the case including the base, side walls, end wall and top may be formed from any suitable material, preferably plastic with the parts being individually formed and joined together, such as by bonding. Of course, other materials and constructions may be employed.

Figure 2:
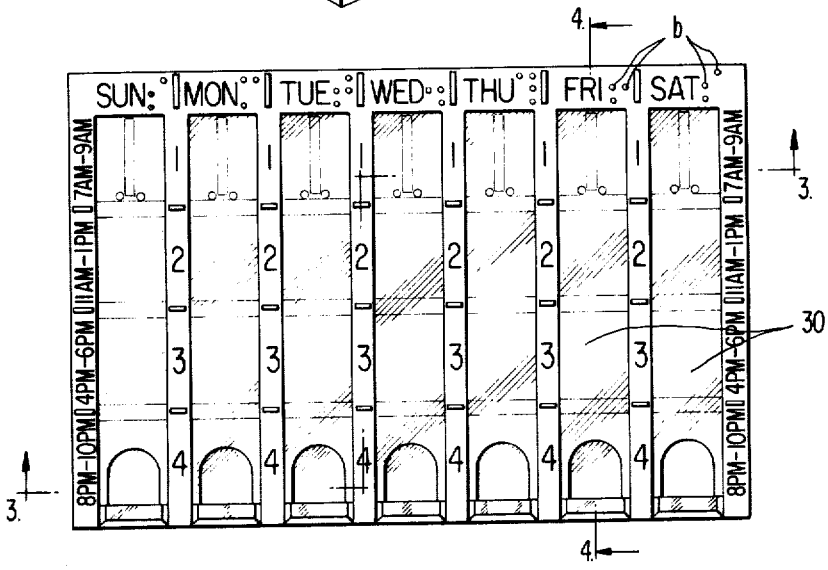
FIG. 2 is a plan view of the dispenser of FIG. 1.
Figure 3:
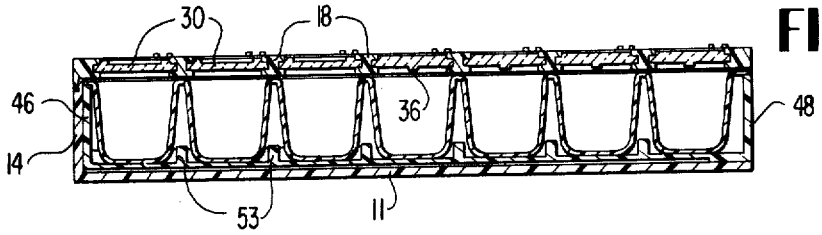
FIG. 3 is a cross-sectional view taken generally along lines 3—3 of FIG. 2.
Figure 4:
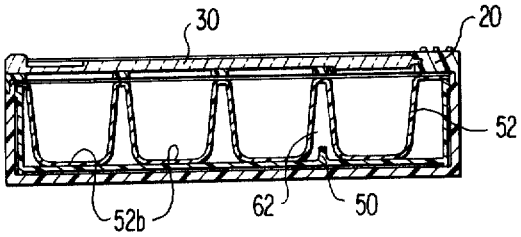
FIG. 4 is a cross-sectional view taken generally along lines 4—4 of FIG. 2.

It will be seen that the top of case 8 forms a rectangular grid pattern defining a plurality of rows of apertures which, in the specific embodiment, are seven rows corresponding to 7 days in a week with four apertures in each row corresponding to four times a day for the taking of medicines from the dispenser as will be further described. It is preferred that the top of the case be provided with indicia of the days of the week on the side piece 20 and the different dosage times of each day on the end pieces 16, as shown in FIG. 2. It is also preferred that braille *b* be applied at these areas for blind people. In addition, it is preferred that numerals 1, 2, 3 and 4 be placed along the top of ribs 18, as shown in FIG. 2 to indicate the sequence of the dosage time during each day.

As noted above, a plurality of transparent cover strips 30 in the form of flat elongated, rectangular pieces are slidably received for slidable movement in recesses 22 formed by ribs 18 of the case top. There are seven cover strips 30 corresponding to the seven days of the week and the seven rows in the top of the case. In order to control the opening and closing of the apertures in the top of the case, stop elements in the form of projections 38 are formed on the under side of the cover strips 30 to be engageable with support ribs 24 to provide engagement to inhibit movement of the strips in the top of the case. In addition, an elongated stop 36 is provided to project from the underside of strips 30; the length of stop 36 being approximately equal to the length of an aperture in the top wall of the case. Projections 36 and 38 control movement of the cover strips 30 during opening and closing of an aperture in the top of the case. Furthermore, once the aperture is open, stops 36 and 38 are located between and are engageable with ribs 24 to prevent further accidental movement of the strips 30 during dispensing of the contents. Cover strips 30 are made from transparent material, preferably plastic. In addition, it is preferred that the ends of strips 30 be formed with finger recesses 32 and flanges 34 (see FIG. 1) to facilitate handling.

As best shown in FIG. 5, tray 40 includes a base 41 shown as rectangular, upstanding side walls 40 and 42 and end walls 46 and 48 defining an open-top box-like structure dimensioned to be slidably received in case 8 through the open end thereof. During insertion in the case, end 46 of tray 40 leads the opposite end 48 which is provided with a pair of laterally projecting flanges **48*a* which engage the side walls 12 of the case at the open end when the tray is fully inserted. The length of tray end wall 48, including flanges 48*a* is such that end 48 cannot be inserted in the opening of the case. Thus, tray 40 can only be inserted in the case in the proper position. In order to provide a square fit without any projecting edges, base 11 of the case projects slightly at 11*a* from the adjacent end walls 12 of the case to provide a ledge which receives end wall 48 of tray 40. If desired, any one of the side or end walls, such as side wall 44 may be provided with a recess 48** to receive labeling material, or other information.

The medicine which may be in tablet, pill or capsule form is held in a plurality of compartments which, in the preferred embodiment, are formed in the tray insert generally designated 50. Preferably, tray insert 50 is manufactured so as to be disposable after a week's dosage and to this end, it may be formed from a one-piece molded plastic, including opposite marginal side flanges 54 and 56 and end flanges 60 and 62 with a plurality of depending compartments each formed by walls 52 and **52*a* and bottom wall 52*b* for receiving the medicine. Since in the preferred embodiment shown, the dispenser is for use over a week's period, there are seven rows of compartments in the insert tray 50** corresponding to the 7 days in the week. Similarly, each row includes four compartments.

The dimensions of tray insert 50 and its compartments are designed so that tray insert 50 can only be inserted in the proper position within tray 40; that is, with the first row (on the left as viewed in FIG. 5) located adjacent end wall 46 of the tray. To this end, base 41 of tray 40 is provided with positioning means in the form of a plurality of studs 53 fixed to and projecting upwardly therefrom to be received in the spaces **53*a* (see FIG. 5) between the rows of compartments in tray insert 50. In addition, base 41 of the tray is provided with one or more elongated flanges 50 which, in the shown embodiment, extent throughout the longitudinal extent of base 41 so as to be receivable in the spaces 62 between the compartments in each of the rows. Although only one set of studs 53 and flange 50 are shown, it will be understood that a plurality of sets of flanges and studs may be employed throughout the base 41 of the tray 40. Tray insert 50, including its compartments is designed relative to tray 40 and the positioning studs 53 and flange 50 such that should tray insert 50 be inserted in improper position in the tray 40, tray insert 50 will not become seated against tray base 41 but rather studs 53 and flange 50 will engage against the bottoms 52*b* of the tray insert compartments to prevent proper seating. This will inform the patient to reverse tray insert 50 to permit the positioning studs 53 to be received in spaces 53*a* between the tray insert compartments and similarly to permit flange 50 to be received in space 62 between the insert compartments. When tray insert 50 is properly seated within tray 40, not only will the studs 53 and flange 50 be properly located, but furthermore the marginal flanges 54, 56, 58 and 60 of tray insert 50 will lie flush with the upper edges of the side and end walls 40, 42, 46, 48 of tray 40. If, on the other hand, tray insert 50 is not properly positioned, not only will positioning studs 53 and flange 50 indicate this, but furthermore marginal flanges 54, 56, 58 and 60** will not lie flush with the upper edges of the tray.

The correct position of tray insert 50 relative to tray 40 is illustrated in FIG. 5 where the widest marginal flange 54 is positioned to overlie side wall 42 of tray 41. The arrows indicated in the bottom of FIG. 5 indicate how tray insert 50 is lowered into tray 40 in proper position. When in this position, each of the compartments of tray insert 50 will correspond in position to the apertures in the top of case 8 so that when tray 40 with its insert 50 is inserted in case 8, each of the tray insert compartments will be positioned directly below the apertures in the top of the case. Starting from the left as viewed in FIG. 5, the first row of four compartments will correspond to Sunday, the second row to Monday, the third row to Tuesday and so on through Saturday, completing the period of a week. The four compartments in each row correspond to four different times during the day that the pills are to be taken. These four times could correspond to morning, noon, afternoon and evening and the times may be indicated on the top pieces 16 and 18 of the case, as shown in FIG. 2 and described above.

When the week's dosage of medicine has been taken, the patient may remove tray 40 by pushing end wall 46 thereof through aperture 14*a* formed in end wall 14 of the case as shown in FIG. 1. Tray insert 50 may then be removed and discarded or may be replenished with medicines for the next week. If tray insert 50 is discarded, the patient may obtain another one from his doctor or pharmacist. Moreover, the doctor or pharmacist may fill the tray insert 50 with the proper medicine to be taken at the prescribed times throughout the course of a week. In order to aid the person filling the tray insert with a new week's supply of medicine, it is preferred that the tray insert be suitably marked. For example, the bottoms 52*b* of the first row on the left (Sunday) are with the indicia 1, 2, 3 and 4. In this instance, numeral 1 would indicate that the time for taking the medicine from that compartment would be in the morning or the first time period for the given day, the numeral 2 would indicate noon, 3 afternoon and 4 evening. Through this indicia, the person filling the tray will know how to hold the tray and which rows correspond to which day in the week and which compartments within each row correspond to the proper time period for that day. In addition, through usage, the person filling the tray will recognize that the wider marginal flange 54 of tray insert 50 should be at the head or top thereof when the tray insert is in the proper position. Of course, any other indicia may be used to indicate which compartments rows correspond to a day in the week and which compartment in each row corresponds to a daily dosage time.

After the tray insert 50 is replenished with another week's dosage, it is positioned in tray 40 with the positioning stops 53 and flange 50 located between the compartments of the tray insert; and then tray 40 is inserted into the case to complete the charging of the case. When the dispenser is not being used, all of the cover strips 30 will, of course, be in closed position, that is, covering all of the medicine compartments in the associated row. When it is desired to dispense medicine from any of the compartments, the particular cover strip 30 is slid along recesses 22 to open the desired compartment. After the medicine is dispensed from that compartment, the cover strip 30 is returned to closed position, closing all of the compartments.

Referring to FIGS. 6, 7 and 8, there is shown a preferred modification of the present invention wherein a sealing cover 70 having a generally rectangular configuration conforming to the generally rectangular configuration of the tray insert 50 is utilized to seal the medicine in the tray insert compartments after the compartments are initially charged with medicine and prior to the time that the tray insert is inserted into the dispenser case. In the particular embodiment shown, sealing cover 70 is a sheet member made from a suitable self-supporting material, such as plastic, and having inturned side edges 80 to be receivable about the marginal flange portions 54 and 56 of the tray insert 50 as shown in FIG. 8. In addition, one end of sealing cover 70 is formed with inturned portions 76 which may extend continuously across sealing cover 70 or may merely be one or two individual inturned portions 76 receivable about marginal flange 60 of tray insert 50 as shown in FIG. 7.

However, the opposite end of sealing cover 70 is formed with an offset portion 72 located below the main plane of sealing cover 70 so as to be receivable below the top piece 16 of the case during insertion of the tray into the case. FIG. 6 shows sealing cover 70 only partially positioned on the tray insert 50 for purposes of illustration. However, after tray insert 50 is charged with a week's dosage of medicine, sealing cover 70 is placed on tray insert 50 to completely close all of the compartments, for example, as shown in FIG. 7. In this way, the medicine is kept in sealed and sanitary condition until it is safely charged into the dispenser case.

After tray insert 50 is provided with a sealing cover 70, it is lowered into tray 40 as indicated by the arrows in the right-hand side of FIG. 9. Tray 40 with insert 50 therein is then introduced in the open end of case 8 and with the offset portion 72 of sealing cover 70 received below top piece 16 of the case, as shown in FIG. 10. Because of offset portion 72 on sealing cover 70, a lip or ridge 72*a* is formed along the leading end of sealing cover 70 which engages top piece 16 of the dispenser case as shown in FIG. 10 so that as the tray 40 is pushed into the case, sealing cover 70 will be prevented from moving into the case with tray 40 by means of top end piece 16 of the case. Thus, sealing cover 70 will be stripped from the top of tray insert 40 as the tray is being inserted in the case. When the tray is fully inserted, cover 70 will have been completely separated from the tray insert 50 as shown in FIG. 11. It is preferred that sealing cover 70 be made from a suitable plastic material. Also, it is preferred that the plastic material be susceptible to printing or writing so that the prescription may be written or printed directly on the sealing cover by the pharmacist of physician. However, a thin label may also be attached to the sealing cover with the prescription written on the label. Of course, any other suitable material may be employed for the sealing cover 70.

Although one specific sealing cover 70 has been shown and described, others may be employed, for example, thin sheet material with adhesive along the marginal edges adhering to the peripheral flange portions of the tray insert in a manner which may be disrupted by pressure imposed against lip 72 of the sealing cover 70 during insertion of tray 40 into the case 8, as described above. It is also contemplated that a sealing cover may be employed which may be stripped from the tray insert 50 by hand, that is, prior to insertion of the tray 40 in the case.

What is claimed is:

1. A medicine dispenser for storing and dispensing medicines according to certain prescribed times, the dispenser including in combination, a case having a base, side walls upstanding from the base and a top on the side walls defining a space for receiving a tray, a tray receivable in the case below the top and being removable from the case, means in the tray forming a number of compartments for receiving and storing medicine in accordance with certain prescribed times at which the medicine is to be taken, and wherein said top includes transparent portions movable over the compartments to open the compartments for dispensing medicine or for closing the compartments for storing medicine, and wherein said means forming said compartments in the tray is an insert, including said compartments, said insert being removably received in the tray.

2. The medicine dispenser defined in claim 1 wherein said tray has a base and upstanding side and end walls and wherein said tray insert is received within the confines of side and end walls of the tray.

3. The medicine dispenser defined in claim 2 wherein said tray insert has a peripheral flange portion engageable on the side and end walls of said tray.

4. The medicine dispenser defined in claim 3 wherein said tray insert is made from light-weight thin plastic material.

5. The medicine dispenser defined in claim 3 wherein said tray insert has a first peripheral flange portion extending alone one side thereof to indicate the proper orientation of the tray insert in the tray.

6. The medicine dispenser defined in claim 2 wherein the compartments of said tray insert are defined by spaced compartment side walls and wherein there is further included positioning means on the base of the tray receivable between compartment side walls of the tray insert to properly position the tray insert in the tray.

7. The medicine dispenser defined in claim 6 wherein said positioning means are a plurality of studs projecting upwardly from the base of the tray.

8. The medicine dispenser defined in claim 1 further including a sealing cover extending over the top of said tray for sealing the medicine contents therein, said sealing cover being removable from the tray prior to insertion of the tray in the case.

9. The medicine dispenser defined in claim 8 wherein said sealing cover has opposite side edge portions engaging opposite sides of the tray insert, and wherein said case has an open end for slidably receiving the tray therein, and wherein said sealing cover of the tray insert is engageable with the top of the case at said open end thereof during insertion of the tray in the case to remove the sealing cover from the tray insert as the tray with the tray insert are being inserted in the case.

10. The medicine dispenser defined in claim 9 wherein one end of said sealing cover has an offset portion offset below a top plane of the sealing cover to be receivable under the top of the case during insertion of the tray in the case, said offset portion being in part defined by a lip on the sealing cover engageable with the top of the case during insertion of the tray in the case to automatically strip the sealing cover from the tray insert during insertion of the tray in the case.

11. The medicine dispenser defined in claim 8 wherein said tray and tray insert have indicia means thereon for properly positioning the tray insert in the tray with the medicine compartments properly arranged according to the time at which the medicines therein are to be taken by a patient.

12. The medicine dispenser defined in claim 11 wherein the compartments of said tray insert are arranged in a plurality of generally parallel rows corresponding to days in the week with each row containing a plurality of compartments corresponding to the times of day the medicine is to be taken by a patient using the dispenser, and wherein said indicia means includes first stop means to be positioned on the base of the tray between compartments in one row and second stop means to be positioned between compartments in adjacent rows when the tray insert is properly positioned in the tray.

13. The medicine dispenser defined in claim 11 wherein the compartments of said tray insert are arranged in a plurality of rows corresponding to days in the week with each row containing a plurality of compartments corresponding to the times of day the medicine is to be taken by a patient, and wherein compartments in at least one of the rows has indicia thereon indicating the proper sequence of times for the medicine therein to be taken.

14. The medicine dispenser defined in claim 1 wherein said tray and tray insert have indicia means thereon for properly positioning the tray insert in the tray with the medicine compartments properly arranged according to the time at which the medicines therein are to be taken by a patient.

15. The medicine dispenser defined in claim 14 wherein the compartments of said tray insert are arranged in a plurality of generally parallel rows corresponding to days in the week with each row containing a plurality of compartments corresponding to the times of day the medicine is to be taken by a patient using the dispenser, and wherein said indicia means includes first stop means to be positioned on the base of the tray between compartments in one row and second stop means to be positioned between compartments in adjacent rows when the tray insert is properly positioned in the tray.

16. The medicine dispenser defined in claim 15 wherein said first stop means includes an elongated member fixed to and projecting upwardly from the base of the tray and wherein said second stop means includes a plurality of studs projecting upwardly from the base of the tray.

17. A medicine dispenser for storing and dispensing medicines according to certain prescribed times, the dispenser including in combination, a case having a base, side walls upstanding from the base and a top on the side walls defining a space for receiving a tray, a tray receivable in the case below the top and being removable from the case, means in the tray forming a number of compartments for receiving and storing medicine in accordance with certain prescribed times at which the medicine is to be taken, and wherein said top includes transparent portions movable over the compartments to open the compartments for dispensing medicine or for closing the compartments for storing medicine, and wherein said case has an end wall extending between the side walls thereof with the opposite end of the case being open, said tray includes a base and opposite side and end walls upstanding from the base of the tray, said tray being dimensioned to be slid into the case through said open end of the case.

18. The medicine dispenser defined in claim 17 wherein one of said ends of the tray has stop means projecting laterally therefrom to be engageable with the ends of the side walls of the case to indicate which end of the tray is to lead in the case during insertion of the tray in the case.

19. The medicine dispenser defined in claim 18 wherein said end wall of the case has an aperture therein for receiving a finger for pushing the tray out of the case.

20. The medicne dispenser defined in claim 17 wherein there are seven rows of compartments in the trays and seven transparent top portions in the top of the case movable over the rows of compartments respectively in a direction generally parallel to the end wall of the case.

21. A medicine dispenser for storing and dispensing medicines according to certain prescribed times, the dispenser including in combination, a case having a base, side walls upstanding from the base and a top on the side walls defining a space for receiving a tray, a tray receivable in the case below the top and being removable from the case, means in the tray forming a number of compartments for receiving and storing medicine in accordance with certain prescribed times at which the medicine is to be taken, said top including at least one transparent portion movable over the compartments to open the compartments for dispensing medicine or for closing the compartments for storing medicine, and wherein said means forming said compartments in the tray is an insert including said compartments, said insert being movably received in the tray.

22. The medicine dispenser defined in claim 21 further including a sealing cover extending over the top of said tray for sealing the medicine contents therein, said sealing cover being removable from the tray prior to insertion of the tray in the case.

23. The medicine dispenser defined in claimn 22 wherein said tray and tray insert have indicia means thereon for properly positioning the tray insert in the tray with the medicine compartments properly arranged according to the time at which the medicines therein are to be taken by a patient.

24. The medicine dispenser defined in claim 23 wherein said sealing cover is attached to the tray insert.

* * * * *